US012152292B2

(12) United States Patent
Bürger et al.

(10) Patent No.: US 12,152,292 B2
(45) Date of Patent: Nov. 26, 2024

(54) METHOD OF PRODUCING A HIGH-ENERGY HYDROFORMED STRUCTURE FROM A 2XXX-SERIES ALLOY

(71) Applicant: Airbus SAS, Blagnac (FR)

(72) Inventors: Achim Bürger, Koblenz (DE); Andreas Harald Bach, Koblenz (DE); Sabine Maria Spangel, Koblenz (DE); Philippe Meyer, Koblenz (DE)

(73) Assignee: AIRBUS SAS, Blagnac (FR)

( * ) Notice: Subject to any disclaimer, the term of this patent is extended or adjusted under 35 U.S.C. 154(b) by 561 days.

(21) Appl. No.: 17/599,661

(22) PCT Filed: Mar. 23, 2020

(86) PCT No.: PCT/EP2020/057938

§ 371 (c)(1),
(2) Date: Sep. 29, 2021

(87) PCT Pub. No.: WO2020/200869

PCT Pub. Date: Oct. 8, 2020

(65) Prior Publication Data

US 2022/0056562 A1 Feb. 24, 2022

(30) Foreign Application Priority Data

Apr. 3, 2019 (EP) ..... 19167004

(51) Int. Cl.
*C22C 21/18* (2006.01)
*C21D 9/46* (2006.01)
(Continued)

(52) U.S. Cl.
CPC ..... *C22C 21/18* (2013.01); *C21D 9/46* (2013.01); *C22C 21/14* (2013.01); *C22C 21/16* (2013.01); *C22F 1/057* (2013.01)

(58) Field of Classification Search
CPC ..... C22F 1/057; C22C 21/16
See application file for complete search history.

(56) References Cited

U.S. PATENT DOCUMENTS 2,966,740 A 1/1961 Macha et al.
7,093,470 B2 8/2006 El-Soudani
(Continued)

FOREIGN PATENT DOCUMENTS

AU 2013204114 B2 † 9/2013
EP 1945825 B1 6/2014
(Continued)

OTHER PUBLICATIONS

International Search Report; priority document.
(Continued)

*Primary Examiner* — Jessee R Roe
(74) *Attorney, Agent, or Firm* — Greer, Burns & Crain, Ltd.

(57) ABSTRACT

A method of producing an integrated monolithic aluminum structure, comprising: providing an aluminum alloy plate with a thickness of at least 38.1 mm, wherein the plate is a 2xxx-series alloy in a T3-temper and has a composition comprising, in wt. %: Cu 3.8-4.5, Mn 0.3-0.8, Mg 1.1-1.6, Si up to 0.15, Fe up to 0.20, Cr up to 0.10, Zn up to 0.25, Ti up to 0.15, Ag up to 0.10, balance aluminum; optionally pre-machining the plate to an intermediate machined structure; high-energy hydroforming the plate or intermediate structure against a rigid die forming surface having a desired curvature contour of the integrated monolithic aluminum structure, causing the plate or the intermediate structure to conform to the forming surface contour; machining or mechanical milling the high-energy formed structure to a
(Continued)

near-final or final machined integrated monolithic aluminum structure; ageing the final integrated monolithic aluminum structure to a desired temper.

18 Claims, 3 Drawing Sheets

(51) Int. Cl.

| | |
|---|---|
| ***C22C 21/14*** | (2006.01) |
| ***C22C 21/16*** | (2006.01) |
| ***C22F 1/05*** | (2006.01) |
| ***C22F 1/057*** | (2006.01) |

(56) References Cited

U.S. PATENT DOCUMENTS

| | | | |
|---|---|---|---|
| 7,610,669 | B2 | 11/2009 | Keidel et al. |
| 2004/0211498 | A1 | 10/2004 | Keidel et al. |
| 2006/0011272 | A1 † | 1/2006 | Lin |
| 2015/0315666 | A1 | 11/2015 | Harrison et al. |
| 2018/0264537 | A1 | 9/2018 | Plaut |

FOREIGN PATENT DOCUMENTS

| | | | |
|---|---|---|---|
| FR | 3031056 | A1 | 7/2016 |
| WO | 2007048565 | A1 † | 5/2007 |
| WO | 2017137260 | A1 † | 8/2017 |

OTHER PUBLICATIONS

Display Board, Jun. 20, 2017,2, Paris Air Show, Paris France.†
R Prummer, Residual Stress Relief Treatment by Shock Waves, 3, Nov. 1998, Metallwissenschaft und Technik.†
US Army Production Equipment Agency, Review of Explosive (Chemical) Forming, 140, Apr. 1965, US Government, Apr. 1965, Illinois.†
Martin Co, Explosive Forming of 2219 Aluminum Final Report, 137, Jun. 1965, NASA, Huntsville AL.†
Aluminum Association, International Alloy Designations and Chemical Composition Limits for Wrought Aluminum and Wrought Aluminum Alloys, 45, Aug. 2018, Aluminum Association, Arlington VA.†
Ilia Islamoff, Metal-Forming Techniques, 60, May 1965, NASA, Huntsville AL.†
D E Strohecker et al, 68, May 1964, Defense Metals Information Center Battelle Memorial Institute, Columbus OH.†
Air Show Display Board, 2, Jun. 21, 2017, Paris Air Show, Paris France.†

† cited by third party

METHOD OF PRODUCING A HIGH-ENERGY HYDROFORMED STRUCTURE FROM A 2XXX-SERIES ALLOY

CROSS-REFERENCES TO RELATED APPLICATIONS

This application claims the benefit of the International Application No. PCT/EP2020/057938, filed on Mar. 23, 2020, and of the European patent application No. 19167004.1 filed on Apr. 3, 2019, the entire disclosures of which are incorporated herein by way of reference.

FIELD OF THE INVENTION

The invention relates to a method of producing an integrated monolithic aluminum alloy structure, and can have a complex configuration, that is machined to near-net-shape out of a plate material. More specifically, the invention relates to a method of producing an integrated monolithic aluminum alloy structure made from a 2xxx-series alloy and can have a complex configuration that is machined to near-net-shape out of a plate material. The invention relates also to an integrated monolithic aluminum alloy structure produced by the method of this invention and to several intermediate semi-finished products obtained by the method.

BACKGROUND OF THE INVENTION

U.S. Pat. No. 7,610,669-B2 (Aleris) discloses a method for producing an integrated monolithic aluminum structure, in particular an aeronautical member, comprising the steps of:

(a) providing an aluminum alloy plate with a predetermined thickness, the plate having been stretched after quenching and having been brought to a first temper selected from the group consisting of T4, T73, T74 and T76, wherein the aluminum alloy plate is produced from a AA7xxx-series aluminum alloy having a composition consisting of, in wt. %: 5.0-8.5% Zn, 1.0-2.6% Cu, 1.0-2.9% Mg, <0.3% Fe, <0.3% Si, optionally one or more elements selected from the group of Cr, Zr, Mn, V, Hf, Ti, the total of the optional elements not exceeding 0.6%, incidental impurities and the balance aluminum, (b) shaping the alloy plate by means of bending to obtain a predetermined shaped structure having a pre-machining thickness in the range of 10 to 220 mm, the alloy plate in the first temper selected from the group consisting of T4, T73, T74 and T76 to form the shaped structure having a built-in radius, (c) heat-treating the shaped structure, wherein the heat-treating comprises artificially aging the shaped structure to a second temper selected from the group consisting of T6, T79, T78, T77, T76, T74, T73 or T8, (d) machining the shaped structure to obtain an integrated monolithic aluminum structure as the aeronautical member for an aircraft, wherein the machining of the shaped structure occurs after the artificial ageing.

It is suggested that the disclosed method can be applied also to AA5xxx, AA6xxx and AA2xxx-series aluminum alloys.

There is a demand for forming integrated monolithic aluminum structures of more complex configuration from a thick plate product.

SUMMARY OF THE INVENTION

As will be appreciated herein, except as otherwise indicated, aluminum alloy designations and temper designations refer to the Aluminum Association designations in Aluminum Standards and Data and the Registration Records, as published by the Aluminum Association in 2018 and are well known to the person skilled in the art. The temper designations are laid down in European standard EN515.

For any description of alloy compositions or preferred alloy compositions, all references to percentages are by weight percent unless otherwise indicated.

As used herein, the term "about" when used to describe a compositional range or amount of an alloying addition means that the actual amount of the alloying addition may vary from the nominal intended amount due to factors such as standard processing variations as understood by those skilled in the art.

The term "up to" and "up to about", as employed herein, explicitly includes, but is not limited to, the possibility of zero weight-percent of the particular alloying component to which it refers. For example, up to 0.25% Zn may include an aluminum alloy having no Zn.

"Monolithic" is a term known in the art meaning comprising a substantially single unit which may be a single piece formed or created without joint or seams and comprising a substantially uniform whole.

It is an object of the invention to provide a method of producing an integrated monolithic aluminum alloy structure of complex configuration that is machined to near-net-shape.

It is another object of the invention to provide a method of producing an integrated monolithic 2xxx-series aluminum alloy structure of complex configuration that is machined to near-net-shape out of thick gauge plate material.

These and other objects and further advantages are met or exceeded by the present invention providing a method of producing an integrated monolithic aluminum structure, the method comprising the process steps of providing an aluminum alloy plate with a predetermined thickness of at least 31.75 mm (1.25 inches), wherein the aluminum alloy plate is a 2xxx-series alloy provided in a T3-temper, and preferably in a T351-temper, and wherein the 2xxx-series alloy has a composition comprising of, in wt. %:

Cu 3.8% to 4.5%,
Mn 0.3% to 0.8%,
Mg 0.9% to 1.6%,
Si up to 0.15%,
Fe up to 0.20%,
Cr up to 0.10%,
Zn up to 0.25%,
Ti up to 0.15%,
Ag up to 0.10%,
impurities and balance aluminum;

optionally pre-machining of the aluminum alloy plate to an intermediate machined structure;

high-energy hydroforming of the plate or the intermediate machined structure against a forming surface of a rigid die having a contour at least substantially in accordance with a desired curvature of the integrated monolithic aluminum structure, the high-energy forming causing the plate or the intermediate machined structure to substantially conform to the contour of the forming surface having at least one uniaxial curvature or a biaxial curvature;

machining or mechanical milling of the high-energy formed structure to a near-final or final machined integrated monolithic aluminum structure; and ageing of the integrated monolithic aluminum structure to a desired temper to develop the required strength and other engineering properties relevant for the intended application of the integrated monolithic aluminum structure.

As is well-known in the art, a T3-temper means that the 2xxx-series starting plate product has been solution heat treated, cold worked, and naturally aged. The designation Tx51 refers to stress relied by controlled stretching after solution heat treatment.

During the high-energy hydroforming of thick gauge aluminum alloy plate material variation in the deformation degree may occur in the plate material, e.g. in the thickness direction, but also in the length and width direction, depending on the required contour of the high-energy hydro-formed structure having at least a uniaxial curvature or a biaxial curvature. In accordance with the invention, it has been found that a plate material of the claimed 2xxx-series alloy composition having no purposive addition of silver when provided in a T3 starting condition and processed in accordance with this invention and aged to a final T8 condition is almost insensitive for a variation of the deformation degree at least up to about 12%. This is an important finding as the substantially insensitivity leads to much more constant mechanical properties and other engineering properties across the various directions in the final product when aged to final temper, for example to a T8 condition. A further advantage is that an Ag-free 2xxx-series alloy is much more cost effective than an Ag-containing 2xxx-series alloy.

In an embodiment, the 2xxx-series plate material in T3 temper is pre-machined, such as by turning, milling, and drilling, to an intermediate machined structure. Preferably, the ultra-sonic dead-zone is removed from the plate product. And depending on the final geometry of the integrated monolithic aluminum structure, some material can be removed to create one or more pockets in the plate material and a more near-net-shape to the forming die. This may facilitate the shaping during the subsequent high-energy hydroforming operation.

In an embodiment of the method according to this invention, the high-energy hydroforming step is by means of explosive forming. The explosive forming process is a high-energy-rate plastic deformation process performed in water or another suitable liquid environment, e.g., an oil, to allow ambient temperature forming of the aluminum alloy plate. The explosive charge can be concentrated in one spot or distributed over the metal, ideally using detonation cords. The plate is placed over a die and preferably clamped at the edges. In an embodiment the space between the plate and the die may be vacuumed before the forming process.

Explosive-forming processes may be equivalently and interchangeably referred to as "explosion-molding", "explosive molding", "explosion-forming" or "high-energy hydroforming" (HEH) processes. An explosive-forming process is a metalworking process where an explosive charge is used to supply the compressive force (e.g., a shockwave) to an aluminum plate against a form (e.g., a mold) otherwise referred to as a "die". Explosive-forming is typically conducted on materials and structures of a size too large for forming such structures using a punch or press to accomplish the required compressive force. According to one explosive-forming approach, an aluminum plate, up to several inches thick, is placed over or proximate to a die, with the intervening space, or cavity, optionally evacuated by a vacuum pump. The entire apparatus is submerged into an underwater basin or tank, with a charge having a predetermined force potential detonated at a predetermined distance from the metal workpiece to generate a predetermined shockwave in the water. The water then exerts a predetermined dynamic pressure on the workpiece against the die at a rate on the order of milliseconds. The die can be made from any material of suitable strength to withstand the force of the detonated charge such as, for example, concrete, ductile iron, etc. The tooling should have higher yield strength than the metal workpiece being formed.

In an embodiment of the method according to this invention, the high-energy hydroforming step is by means of electrohydraulic forming. The electrohydraulic forming process is a high-energy-rate plastic deformation process preferably performed in water or another suitable liquid environment, e.g., an oil, to allow ambient temperature forming of the aluminum alloy plate. An electric arc discharge is used to convert electrical energy to mechanical energy and change the shape of the plate product. A capacitor bank delivers a pulse of high current across two electrodes, which are positioned a short distance apart while submerged in a fluid. The electric arc discharge rapidly vaporizes the surrounding fluid creating a shock wave. The plate is placed over a die and preferably clamped at the edges. In an embodiment the space between the plate and the die may be vacuumed before the forming process.

A coolant is preferably used during the various pre-machining and machining or mechanical milling processes steps to allow for ambient temperature machining of the aluminum alloy plate or an intermediate product. Preferably wherein the pre-machining and the machining to near-final or final machined structure comprises high-speed machining, preferably comprises numerically-controlled (NC) machining.

Following the high-energy hydroforming step and depending on the required final temper, the resultant structure is solution heat-treated and cooled to ambient temperature. One of the objects is to heat the structure to a suitable temperature, generally above the solvus temperature, holding at that temperature long enough to allow soluble elements to enter into solid solution, and cooling rapidly enough to hold the elements as much as feasible in solid solution. The suitable temperature is alloy dependent and is commonly in a range of about 460° C. to 535° C. and can be performed in one step or as a multistep solution heat-treatment. The solid solution formed at high temperature may be retained in a supersaturated state by cooling with sufficient rapidity to restrict the precipitation of the solute atoms as coarse, incoherent particles.

The solution heat-treatment followed by cooling is important because of obtaining an optimum microstructure that is substantially free from grain boundary precipitates that deteriorate corrosion resistance, strength, and damage tolerance properties and to allow as much solute to be available for subsequent strengthening by means of ageing.

In an embodiment of the method according to this invention, the intermediate high-energy hydroformed product is stress relieved, preferably by an operation including a cold compression type of operation, else there will be too much residual stress impacting a subsequent machining operation.

In an embodiment, the stress relief via a cold compression type of operation is by performing one or more next high-energy hydroforming steps, preferably by applying a milder shock wave compared to the first high-energy hydroforming step creating the initial high-energy hydroformed structure.

In one embodiment, the high-energy formed intermediate structure, and optionally also being stress relieved, is, in that order, next machined or mechanically milled to a near-final or final machined integrated monolithic aluminum structure and followed by ageing to a desired temper to achieve final mechanical properties.

In another more preferred embodiment, the high-energy formed intermediate structure, and optionally also being stress relieved, is, in that order, aged, either by natural ageing or artificial ageing, to a desired temper to achieve final mechanical properties and followed by machining or mechanical milling to a near-final or final machined integrated monolithic aluminum structure. Thus, the machining operation occurs after the ageing operation.

In both embodiments, the ageing to a desired temper to achieve final mechanical properties is selected from the group of: T3, T4, T6, and T8. The artificial ageing step for the T6 and T8 temper preferably includes at least one ageing step at a temperature in the range of 130° C. to 210° C. for a soaking time in a range of 4 to 30 hours.

In a preferred embodiment, the ageing to a desired temper to achieve final mechanical properties is by natural ageing to a T3 temper, more preferably a T37 or T39 temper, or a T352 temper In a preferred embodiment, the ageing to a desired temper to achieve final mechanical properties is to a T6 temper.

In a most preferred embodiment, the ageing to a desired temper to achieve final mechanical properties is to a T8 temper, more preferably an T852, T87 or T89 temper.

In an embodiment, the ageing, either natural or artificial ageing, is to a T354, a T654 or a T854 temper, and represents a stress relieved temper with combined stretching and compression.

In an embodiment, the final aged near-final or final machined high-energy hydroformed integrated monolithic aluminum structure has a tensile yield strength, both in L- and LT-direction, of at least 390 MPa, and more preferably at least 400 MPa. In an embodiment the tensile strength, both in L- and LT-direction; is at least 450 MPa, and more preferably at least 460 MPa. These tensile properties are achieved typically when the high-energy hydroformed structure has been aged to a final T8 temper.

In an embodiment, the predetermined thickness of the aluminum alloy plate is at least 38.1 mm (1.5 inches). In an embodiment, the predetermined thickness of the aluminum alloy plate is at least 50.8 mm (2.0 inches), and preferably at least 63.5 mm (2.5 inches), and more preferably at least 76.2 mm (3.0 inches).

In an embodiment, the predetermined thickness of the aluminum alloy plate is at most 127 mm (5 inches), and preferably at most 114.3 mm (4.5 inches).

The Cu is the main alloying element in the 2xxx-series alloy, and for the method according to this invention, it should be in a range of 3.8% to 4.5%. A preferred upper-limit for the Cu-content is about 4.3%. In an embodiment the upper-limit for the Cu-content is about 4.1%.

Mn is another important alloying element and should be present in a range of 0.30% to 0.8%. In an embodiment the Mn-content is in a range of 0.4% to about 0.8%, and preferably 0.4% to about 0.6%.

Mg is another important alloying element and should be present in a range of 0.9% to 1.6%. A preferred lower limit for the Mg content is about 1.10%, and more preferably about 1.20%. A preferred upper limit for the Mg content is about 1.5%. A preferred upper limit for the Mg content is about 1.40%.

Cr can be present in a range of up to about 0.10%. In an embodiment there is no purposive addition of Cr and it can be present up to about 0.05%, and preferably is kept below 0.04%.

It is an important aspect of the invention that the aluminum alloy has no purposive addition of silver (Ag). It is an impurity element, and it can be present up to about 0.10%, and preferably up to 0.05%, and more preferably up to 0.03%. In a preferred embodiment the silver content is less than about 0.02%, such that the aluminum alloy is substantially free from Ag. With "substantially free" or "essentially free" is meant that no purposeful addition was made to the chemical composition but that due to impurities and/or leaking from contact with manufacturing equipment, trace quantities of Ag may nevertheless find their way into the alloy product. For example, less than 0.01% is an example of a trace quantity.

Zn is an impurity element, and it can be present up to about 0.25%, and preferably up to about 0.10%.

Zr is an impurity element, and it can be present is a range of up to 0.05%, and preferably is present in a range of up to 0.02%.

Fe is a regular impurity in aluminum alloys and can be tolerated up to 0.20%. Preferably it is kept to a level of up to about 0.15%, and more preferably up to about 0.10%, and most preferably up to about 0.05%.

Si is also a regular impurity in aluminum alloys and can be tolerated up to 0.15%. Preferably it is kept to a level of up to 0.10%.

Ti can be added to the alloy product amongst others for grain refiner purposes during casting of the rolling stock. The addition of Ti should not exceed about 0.15%, and preferably it does not exceed 0.06%. A preferred lower limit for the Ti addition is about 0.01%. Ti can be added as a sole element or with either boron or carbon serving as a casting aid, for grain size control.

In this 2xxx-series aluminum alloy, the balance is made by aluminum and impurities, typically each up to 0.05%, total up to 0.15%, and preferably each up to 0.02% and total up to 0.06%.

In a preferred embodiment, the 2xxx-series alloy has no purposive addition of Lithium (Li) at a level of more than about 0.20%, and more preferably the Li content is less than about 0.10%, and most preferably the alloy is substantially free from Li. With "substantially free" or "essentially free" is meant that no purposeful addition was made to the chemical composition but that due to impurities and/or leaking from contact with manufacturing equipment, trace quantities of Li may nevertheless find their way into the aluminum alloy product. For example, less than about 0.02% or less than about 0.01% are examples of a trace quantity.

In an embodiment, the 2xxx-series aluminum alloy has a composition consisting of, in wt. %: Cu 3.8% to 4.5%, Mn 0.3% to 0.8%, Mg 0.9% to 1.6%, Si up to 0.15%, Fe up to 0.20%, Cr up to 0.10%, Zn up to 0.25%, Ti up to 0.15%, Ag up to 0.10%, balance aluminum and impurities each <0.05% and total <0.15%, and with preferred narrower compositional ranges as herein described and claimed.

In a further aspect, the invention relates to an integrated monolithic aluminum structure manufactured by the method according to this invention.

In a further aspect, the invention relates to an intermediate semi-finished product formed by the intermediate machined structure prior to the high-energy hydro forming operation.

In a further aspect, the invention relates to an intermediate semi-finished product formed by the intermediate, and optionally pre-machined, structure having been high-energy hydroformed formed and having at least one of a uniaxial curvature or a biaxial curvature by the method according to this invention.

In a further aspect, the invention relates to an intermediate semi-finished product formed by the intermediate, and optionally pre-machined, structure then high-energy hydroformed and having at least one of a uniaxial curvature and a biaxial curvature, then stress relieved in a cold compression operation, and aged prior to machining into a near-final or final formed integrated monolithic aluminum structure, the ageing is to a desired temper to develop the required strength and other engineering properties relevant for the intended application of the integrated monolithic aluminum structure.

The aged and machined final integrated monolithic aluminum structure can be part of a structure like a fuselage panel with integrated stringers, cockpit of an aircraft, lateral windshield of a cockpit, integral lateral windshield of a cockpit, an integral frontal windshield of a cockpit, front bulkhead, door surround, nose landing gear bay, and nose fuselage.

In a further aspect of the invention, it relates to the use of a 2xxx-series aluminum alloy plate product, preferably in a T3 temper, having a composition of in wt. %: Cu 3.8-4.5%, Mn 0.3-0.8%, Mg 0.9-1.6%, Si up to 0.15%, Fe up to 0.20%, Cr up to 0.10%, Zn up to 0.25%, Ti up to 0.15%, Ag up to 0.05%, impurities and balance aluminum, and a gauge in a range of 31.75 mm to 127 mm in a high-energy hydroforming operation according to this invention, and preferably to produce an aircraft structural part.

BRIEF DESCRIPTION OF THE DRAWINGS

The invention shall also be described with reference to the appended drawings, in which.

DETAILED DESCRIPTION OF THE PREFERRED EMBODIMENTS

Figure 1:
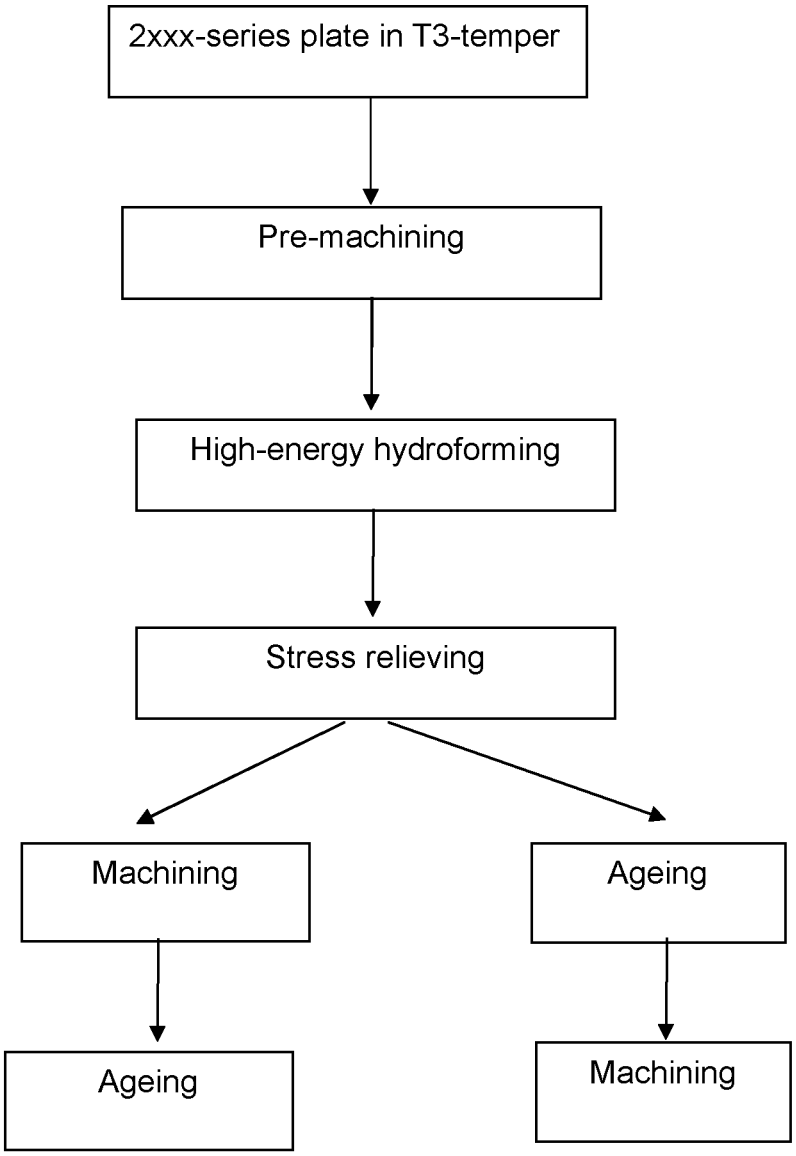
FIG. 1 shows a flow chart illustrating one embodiment of the method according to this invention.

In FIG. 1, the method comprises, in that order, a first process step of providing an 2xxx-series aluminum alloy plate material having a composition as herein described and claimed in a T3-temper and having a predetermined thickness of at least 38.1 mm, with preferred thicker gauges. In a next process step, the plate material is pre-machined (this is an optional process step) into an intermediate machined structure and subsequently high-energy hydroformed, preferably by means of explosive forming or electrohydraulic forming, into a high-energy hydroformed structure with least one of a uniaxial curvature or a biaxial curvature. Preferably, in a next process step, the intermediate product is stress relieved, more preferably in an operation including a cold compression type of operation. Then there is either machining or mechanical milling of the high-energy formed structure to a near-final or final machined integrated monolithic aluminum structure, followed by ageing of the machined integrated monolithic aluminum structure to a desired temper to develop the required strength and other engineering properties relevant for the intended application of the integrated monolithic aluminum structure.

Or in an alternative embodiment, there is firstly ageing of the intermediate integrated monolithic aluminum structure to a desired temper to develop the required strength and other engineering properties relevant for the intended application of the integrated monolithic aluminum structure, followed by machining or mechanical milling of the aged high-energy formed structure into a near-final or final machined integrated monolithic aluminum structure.

Figure 2:
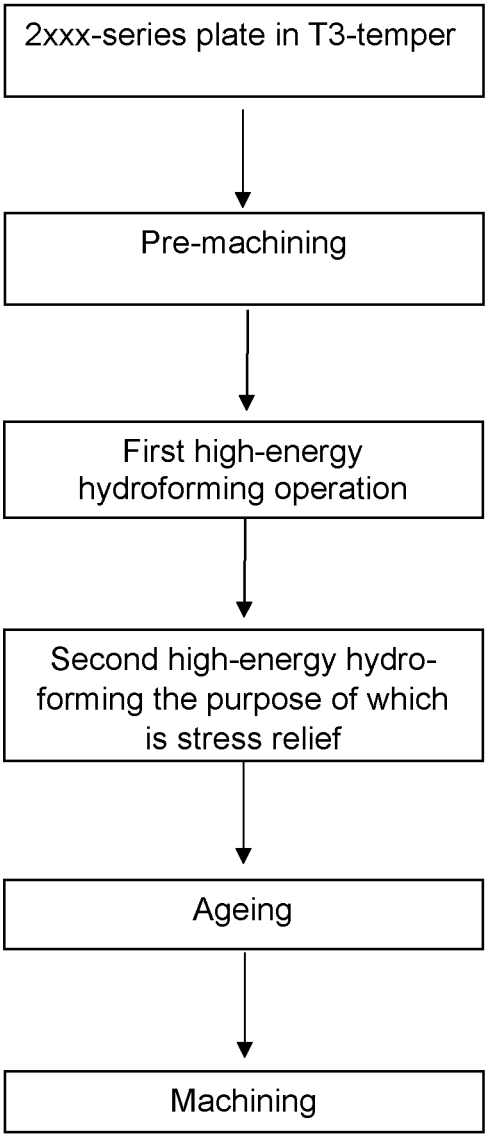
FIG. 2 shows a flow chart illustrating another embodiment of the method according to this invention.

The method illustrated in FIG. 2 is closely related to the method illustrated in FIG. 1, except that in this embodiment there is a first high-energy hydroforming step, followed by performing at least a second high-energy hydroforming step the purpose of which is at least stress relief, followed by the ageing and machining as in the method illustrated in FIG. 1.

Figure 3C:
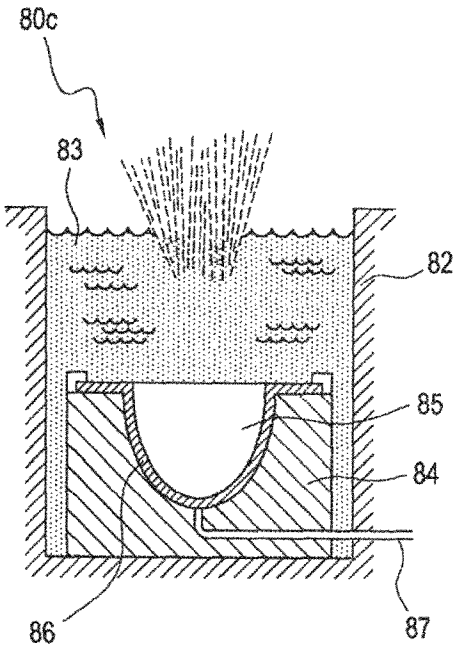
FIGS. 3A, 3B and 3C show cross-sectional side-views of an aluminum plate progressing through stages of a forming process from a rough-shaped metal plate into a shaped, near-finally shaped and finally-shaped workpiece, according to aspects of the present invention.
Figure 3B:
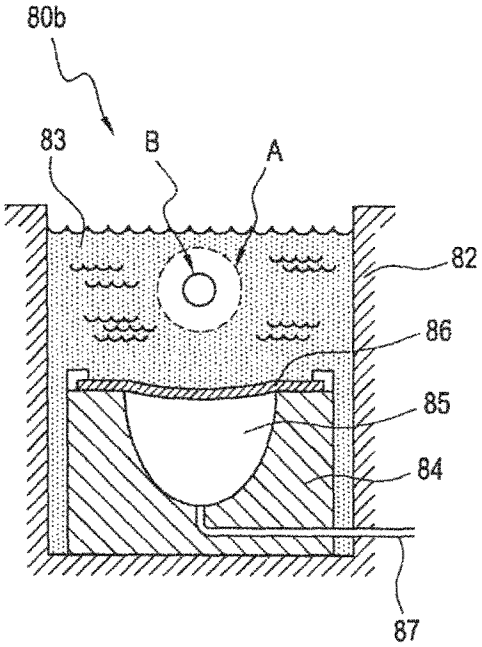
Figure 3A:
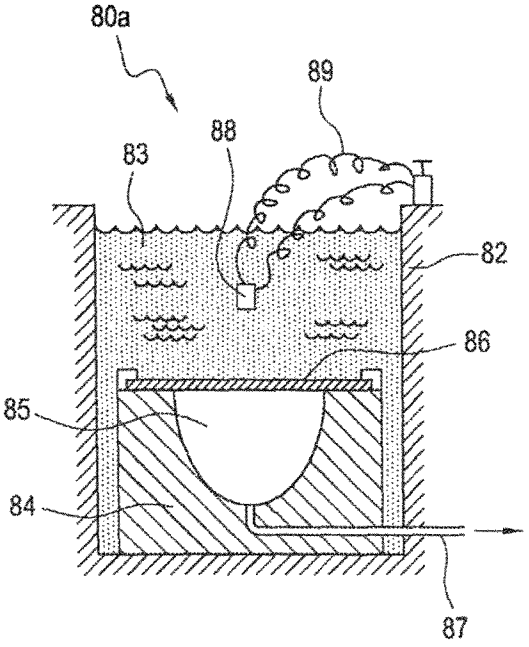

FIGS. 3A, 3B and 3C show a series in progression of exemplary drawings illustrating how an aluminum plate may be formed during an explosive forming process that can be used in the forming processes according to this invention. According to explosive forming assembly 80*a*, a tank 82 contains an amount of water 83. A die 84 defines a cavity 85 and a vacuum line 87 extends from the cavity 85 through the die 84 to a vacuum (not shown). Aluminum plate 86*a* is held in position in the die 84 via a hold-down ring or other retaining device (not shown). An explosive charge 88 is shown suspended in the water 83 via a charge detonation line 89, with charge detonation line 19*a* connected to a detonator (not shown). As shown in FIG. 3B, the charge 88 (shown in FIG. 3A) has been detonated in explosive forming assembly 80*b* creating a shock wave "A" emanating from a gas bubble "B", with the shock wave "A" causing the deformation of the aluminum plate 86*b* into cavity 85 until the aluminum plate 86*c* is driven against (e.g., immediately proximate to and in contact with) the inner surface of die 84 as shown in FIG. 3C.

To provide proof of the principle of the invention, industrially produced plate material of three different alloys have been tested for the influence of the deformation degree on the mechanical properties in the final temper.

Plate material of the three alloys have been solution heat-treated and stretched to arrive at a T351-temper using regular industry practices. The alloy compositions are listed in Table 1. Alloy 1 is an alloy according to this invention and had a gauge of 33 mm, Alloys 2 and 3 are comparative alloys and had a gauge of respectively 25 mm and 27 mm. Samples were cut from all plates and stretched at various degrees in the L-direction to simulate a subsequent deformation step by a high-energy hydroforming operation. Next all samples were artificially aged to a T8 condition and tested for its mechanical properties in the L-direction at mid-thickness (s/2) in accordance with the standard EN2002-1. The results (average over three test samples) are listed in Table 2.

TABLE 1

Alloy compositions of the plate material tested, all percentages are by wt. %, balance is made by aluminum and regular impurities.

| | Element | | | | | | | | |
|---|---|---|---|---|---|---|---|---|---|
| Alloy | Si | Fe | Cu | Mn | Mg | Ti | Cr | Zr | Ag |
| 1 | 0.07 | 0.03 | 3.9 | 0.55 | 1.30 | 0.031 | 0.001 | — | — |
| 2 | 0.05 | 0.07 | 4.7 | 0.3 | 0.54 | 0.037 | 0.001 | 0.11 | 0.33 |
| 3 | 0.05 | 0.06 | 4.6 | 0.27 | 1.0 | 0.042 | 0.06 | 0.10 | — |

TABLE 2

Mechanical properties of the various alloy samples in T8 condition as function of the stretching degrees. Rp0.2 is the yield strength, Rm is the tensile strength, and A the elongation at fracture.

| Alloy | Stretching degree (%) | Rp0.2 [MPa] | Rm [MPa] | A [%] |
|---|---|---|---|---|
| 1 | 0 | 455 | 497 | 11.2 |
| | 2 | 461 | 502 | 10.8 |
| | 4 | 460 | 502 | 11.2 |
| | 6 | 464 | 503 | 10.8 |
| | 8 | 466 | 505 | 10.9 |
| | 10 | 469 | 509 | 10.3 |
| 2 | 0 | 480 | 517 | 11.1 |
| | 2 | 475 | 505 | 12.3 |
| | 4 | 475 | 504 | 11.3 |
| | 6 | 480 | 508 | 11.3 |
| | 8 | 488 | 515 | 10.9 |
| | 10 | 495 | 521 | 10.1 |
| 3 | 0 | 445 | 492 | 13.5 |
| | 2 | 477 | 505 | 12.4 |
| | 4 | 495 | 515 | 11.5 |
| | 6 | 507 | 521 | 11.7 |
| | 8 | 517 | 528 | 10.3 |
| | 10 | 525 | 535 | 10.2 |

From the results of Table 2, it can be seen that Alloy 2, being a 2xxx-series alloy having a purposive addition of silver, provides almost constant mechanical properties with increasing stretching degree. This is in conformity with what the skilled person would expect. There is a very small increase with increasing stretching degree as the skilled person would have expected, as a higher cold deformation degree would lead to small increase of tensile properties in a T8 condition.

Alloy 3 is closely related to Alloy 2 but has no purposive addition of silver. For this aluminum alloy the yield strength and ultimate tensile strength show a steadily increase with increasing stretching degree, whereas the elongation at fracture decreases. When high-energy hydroforming a plate material, depending of the geometry of the final structure, there can be considerable variation in deformation degrees. As the mechanical properties of Alloy 3 show a strong dependency of the stretching degree, this alloy is not a favorable choice for being processed via a high-energy hydroforming operation as it leads to a strong variation of the mechanical properties in the final product at final temper.

Surprisingly, Ag-free Alloy 1 shows a similar trend as Alloy 2, namely it has almost constant mechanical properties with increasing stretching degree. Also, here there is a very small increase in yield strength and tensile strength with increasing stretching degree in the final T8 temper.

Despite the lower Cu-content and the absence of Ag in Alloy 1 compared to Alloy 2, Alloy 1 shows mechanical properties close to those of Alloy 2. As Alloy 1 is also almost insensitive for variation in the deformation degree, this aluminum alloy is an ideal alloy for being processed in a high-energy hydroforming operation and provides fairly constant mechanical properties in the final product. The absence of silver makes the aluminum alloy also more cost effective than silver containing 2xxx-series alloys.

Having now fully described the invention, it will be apparent to one of ordinary skill in the art that many changes and modifications can be made without departing from the spirit or scope of the invention as herein described.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A method of producing an integrated monolithic aluminum structure, the method comprising the steps of:

providing an aluminum alloy plate with a predetermined thickness of at least 31.75 mm, wherein the aluminum alloy plate is a 2xxx-series alloy provided in a T3-temper, and wherein the 2xxx-series alloy has a composition comprising, in wt. %: Cu 3.8% to 4.5%, Mn 0.3% to 0.8%, Mg 0.9% to 1.6%, Si up to 0.15%, Fe up to 0.20%, Cr up to 0.10%, Zn up to 0.25%, Ti up to 0.15%, Ag up to 0.10%, impurities and balance aluminum;

optionally pre-machining of the aluminum alloy plate to an intermediate machined structure;

high-energy hydroforming of the plate or optional intermediate machined structure against a forming surface of a rigid die having a contour in accordance with a desired curvature of the integrated monolithic aluminum structure, the high-energy forming causing the plate or the intermediate machined structure to conform to the contour of the forming surface to at least one of a uniaxial curvature and a biaxial curvature as a high-energy formed structure;

machining or mechanical milling of the high-energy formed structure to a near-final or final machined integrated monolithic aluminum structure; and ageing of the final integrated monolithic aluminum structure to a desired temper.

2. The method according to claim 1, wherein the high-energy hydroforming step is by explosive forming.

3. The method according to claim 1, wherein the high-energy hydroforming step is by electrohydraulic forming.

4. The method according to claim 1, wherein following the high-energy forming operation, in that order, the high-energy formed structure is machined to a final machined integrated monolithic aluminum structure and then aged to a desired temper.

5. The method according to claim 1, wherein the high-energy hydroforming operation, in that order, the high-energy formed structure is aged to a desired temper and then machined to a final machined integrated monolithic aluminum structure.

6. The method according to claim 1, wherein following the high-energy hydroforming operation, the high-energy formed structure is stress-relieved, preferably by compressive forming, followed by machining and ageing to a desired temper of the integrated monolithic aluminum structure.

7. The method according to claim 1, wherein following high-energy hydroforming operation, the high-energy formed structure is stress-relieved, followed by machining and ageing to a desired temper of the integrated monolithic aluminum structure.

8. The method according to claim 7, wherein the high-energy formed structure is stress-relieved by compressive forming in a next high-energy hydroforming step.

9. The method according to claim 1, wherein the predetermined thickness of the aluminum alloy plate is at least 50.8 mm.

10. The method according to claim 1, wherein the predetermined thickness of the aluminum alloy plate is at least 63.5 mm.

11. The method according to claim 1, wherein the predetermined thickness of the aluminum alloy plate is at most 127 mm.

12. The method according to claim 11, wherein the predetermined thickness of the aluminum alloy plate is at most 114.3 mm.

13. The method according to claim 1, wherein the ageing of the integrated monolithic aluminum structure is to a desired temper selected from the group of: T3, T4, T6, and T8.

14. The method according to claim 1, wherein the ageing of the integrated monolithic aluminum structure is to a T8 temper.

15. The method according to claim 14, wherein the ageing of the integrated monolithic aluminum structure is to a T852, T87 or T89 temper.

16. The method according to claim 1, wherein the 2xxx-series aluminum alloy has a Cu-content of 3.8% to 4.3%.

17. The method according to claim 16, wherein the 2xxx-series aluminum alloy has a CU-content of 3.8% to 4.1%.

18. The method according to claim 1, wherein the pre-machining and final machining comprises numerically-controlled machining.

* * * * *